US006564595B2

(12) United States Patent
Junk et al.

(10) Patent No.: US 6,564,595 B2
(45) Date of Patent: May 20, 2003

(54) WASHING MACHINE PUMP HAVING A SINGLE VANE IMPELLER

(75) Inventors: Richard A. Junk, Elkhorn, WI (US); David M. Howie, Foxboro, MA (US)

(73) Assignee: Ark-Les U.S. Controls Corporation, New Berlin, WI (US)

( * ) Notice: Subject to any disclaimer, the term of this patent is extended or adjusted under 35 U.S.C. 154(b) by 89 days.

(21) Appl. No.: 09/775,006

(22) Filed: Feb. 1, 2001

(65) Prior Publication Data

US 2002/0100299 A1 Aug. 1, 2002

(51) Int. Cl.[7] ..... D06F 37/00; F04D 29/24

(52) U.S. Cl. ..... 68/208; 415/208.1; 417/423.14

(58) Field of Search ..... 68/208; 415/121.2, 415/208.1; 416/179; 417/423.1, 423.14

(56) References Cited

U.S. PATENT DOCUMENTS

| | | | | | |
|---|---|---|---|---|---|
| 1,754,992 | A | * | 4/1930 | Fabrin | 415/198.1 |
| 3,261,297 | A | * | 7/1966 | Daniel | 415/183 |
| 3,953,146 | A | * | 4/1976 | Sowards | 415/121.1 |
| 4,076,179 | A | * | 2/1978 | Tsukube | 241/185.6 |
| 4,575,312 | A | | 3/1986 | Erikson | |
| 4,957,420 | A | | 9/1990 | Furuhama | |
| 4,998,861 | A | * | 3/1991 | Fukuzawa et al. | 415/206 |
| 6,264,441 | B1 | * | 7/2001 | Marioni | 134/104.1 |
| 6,328,528 | B1 | * | 12/2001 | Dahlheimer | 277/370 |

* cited by examiner

*Primary Examiner*—Randy Gulakowski
*Assistant Examiner*—Joseph Perrin
(74) *Attorney, Agent, or Firm*—Quarles & Brady LLP

(57) ABSTRACT

An improved pump for washing machines provides resistance to roping of filamentary materials through the use of a single vane impeller. A combination of high clearance and elastomeric vane and asymmetry of the impeller serve to prevent or reduce clogging caused by filamentary materials.

10 Claims, 2 Drawing Sheets

WASHING MACHINE PUMP HAVING A SINGLE VANE IMPELLER

CROSS-REFERENCE TO RELATED APPLICATIONS

--

STATEMENT REGARDING FEDERALLY SPONSORED RESEARCH OR DEVELOPMENT

--

FIELD OF THE INVENTION

The present invention relates to centrifugal pumps for pumping liquids containing solids and in particular to a pump suited for use with clothes washing machines wherein long fiber solids may be encountered.

BACKGROUND OF THE INVENTION

Pumps are used in washing machines to provide water pressure to transfer water through the machine during washing and to empty the machine after use. Dirt, extracted from the clothes, passes through the pump, as does larger debris released from the clothes including items contained in the pockets of the clothes such as toothpicks, paper clips, golf tees, coins, nails, screws and including loose clothing elements such as safety pins and buttons. With high efficiency washing machines, the relative concentration of such debris and dirt increases.

To some degree, passage of these large objects may be provided by increasing pump clearance. Alternatively, a filter may be placed in the water path, however, such filters must be cleaned regularly and can lead to service calls when the filter clogs by a consumer who may be unaware of the filter. A particular problem is long fiber solids such as strings, laces and threads that may entangle the pump rotor or which may "rope" within the pump stopping or greatly reducing fluid flow.

BRIEF SUMMARY OF THE INVENTION

The present invention provides an asymmetric, single-vane centrifugal pump, which has proven to significantly decrease roping so as to pass long fiber solids as well as compact debris.

Specifically, the present invention is a pump for a clothes washing machine of a type having a chamber for containing water and clothes, a chamber having an outlet so that the pump may pump water from the chamber between the inlet and outlet. The pump includes an electric motor having a shaft and a pump housing having a housing inlet connectable to the chamber outlet. The housing provides a pump volume receiving the motor shaft along an axis. A single vane impeller fitting within the pump volume and attached to the motor shaft may drive water from the housing inlet to the housing outlet with rotation of the motor shaft.

Thus it is one object of the invention to permit the pumping of long fiber solids in a washing machine with reduced risk of clogging.

The vane may subtend an angle of less than 270° about an axis concentric with the motor shaft. Further, an edge of the vane closest to the motor shaft may be displaced radially from the motor shaft.

Thus it is another object of the invention to provide a vane construction that is believed to break up static vortices such as may promote roping and clogging by long fiber materials.

The vane may extend, in part, radially from an axis concentric with the motor shaft and a lip of the vane may taper at an end of the vane toward the motor shaft.

Thus it is another object of the invention to reduce points of entanglement with long fiber materials.

The vane may be constructed of an elastomeric material.

Thus it is another object of the invention to provide a vane that is resistant to impacts of entrained objects and to being jammed by materials lodged between the impeller and volute of the pump.

The impeller may project axially from a front surface of a backing disk extending radially from the motor shaft. The pump volume may be substantially cylindrical and the disk may extend to the cylindrical wall of the pump volume. Further, the pump housing may include a stationary vane extending radially and axially adjacent to a rear surface of the backing disk.

Thus it is another object of the invention to provide a design that resists the drawing in entanglement of fibers about the motor shaft. The stationary vane prevents the rotation of water such as might pull material behind the backer plate while the backer plate blocks the material generally.

The backing disk may include a counter weight balancing the backer disk and vane.

Thus it is another object of the invention to provide for smooth operation of the asymmetric vane design of the present invention.

The foregoing objects and advantages may not apply to all embodiments of the inventions and are not intended to define the scope of the invention, for which purpose claims are provided. In the following description, reference is made to the accompanying drawings, which form a part hereof, and in which there is shown by way of illustration, a preferred embodiment of the invention. Such embodiment also does not define the scope of the invention and reference must be made therefore to the claims for this purpose.

DETAILED DESCRIPTION OF THE INVENTION

Figure 1:
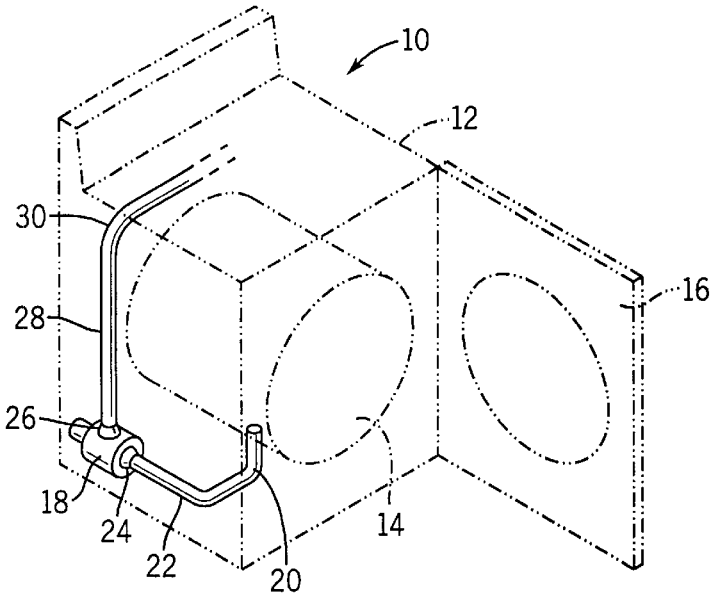
FIG. 1 is a perspective phantom view of a front-loading washing machine showing location of a pump of the present invention for pumping water from a washing tub.

Referring now to FIG. 1, a washing machine 10 may include a housing 12 supporting contained tub 14, the latter opening to allow the insertion of clothes into the tub 14 and closable by a door 16 to seal the tub 14 against the loss of clothes and water during the washing process. A pump 18 may be positioned within the housing 12 to receive from a tub outlet 20 washwater, as communicated through a hose 22 to a pump inlet 24 of the pump 18. The pump 18, in turn, pumps the washwater out of pump outlet 26 through a hose 28 to a discharge pipe 30.

Figure 2:
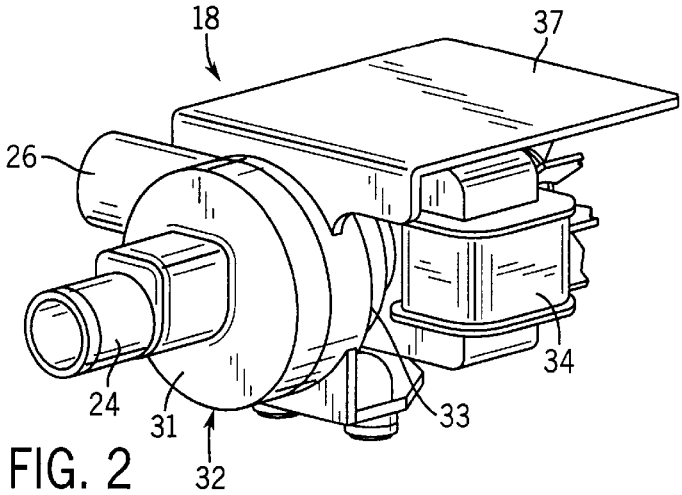
FIG. 2 is a rotated perspective view of the pump of FIG. 1 showing the pump housing and rear positioned motor.
Figure 5:
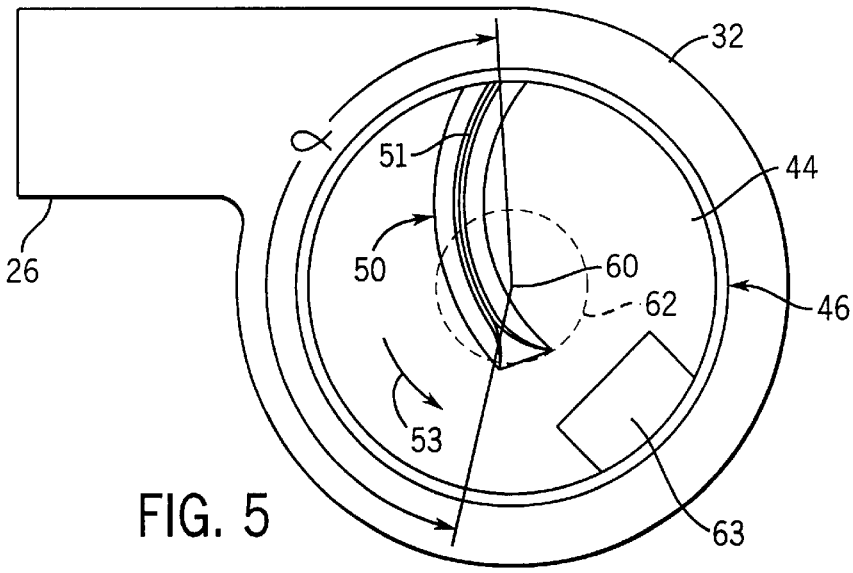
FIG. 5 is a front elevational view of the impeller of FIGS. 3 and 4 with the housing in phantom, showing the position of the single vane of the impeller.

Referring now to FIG. 2, the pump 18 includes a hollow cylindrical pump housing 32 having a substantially flat front face 31 and a cup-shaped rear face 33, concave to the interior of the housing 32. A pump inlet 24 is axially attached to the front face 31 and is a pipe whose internal passageway communicates with the hollow interior of the pump housing 32. Attached along a tangent of the outer rim of the pump housing 32 is pump outlet 26 also a pipe whose internal passageway communicates with the hollow interior of the pump housing 32. Referring momentarily to FIG. 5, the pump outlet 26, the attachment of the pump outlet to the pump housing 32 is done so that the interiors of both together approximate an involute well known in the art of pump design.

Figure 3:
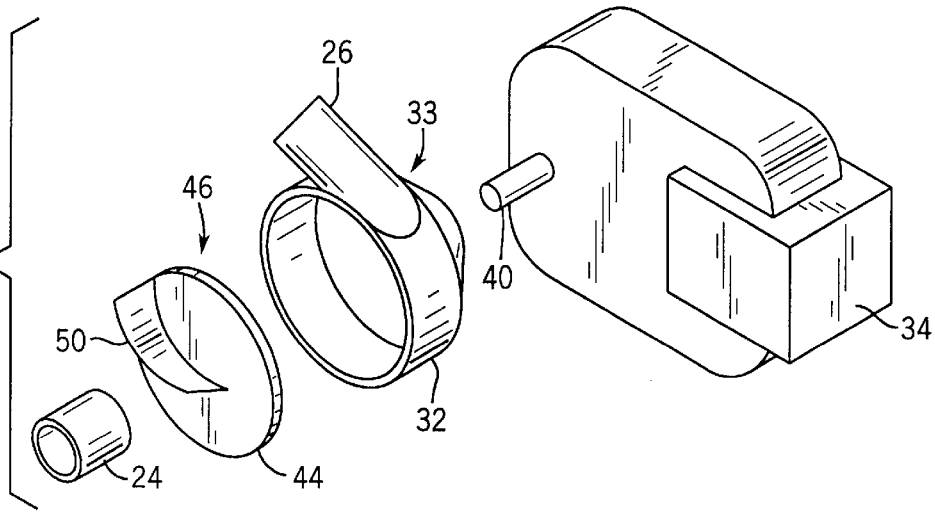
FIG. 3 is an exploded view in partial fragment of the housing of FIG. 2 showing further an internal impeller as positioned with respect to the inlet and outlet of the pump.

Referring to FIGS. 2 and 3, a motor 34 providing an axial motor shaft 40 attaches to a cup-shaped rear face 33 of the pump housing 32 so that the motor shaft 40 may pass centrally therethrough. The housing 32 and the motor 43 are joined and supported by a mounting flange 37 used to affix the pump 18 to the interior of the housing 12 (shown in FIG. 1). The motor 34 may be a standard shaded pole motor.

Figure 4:
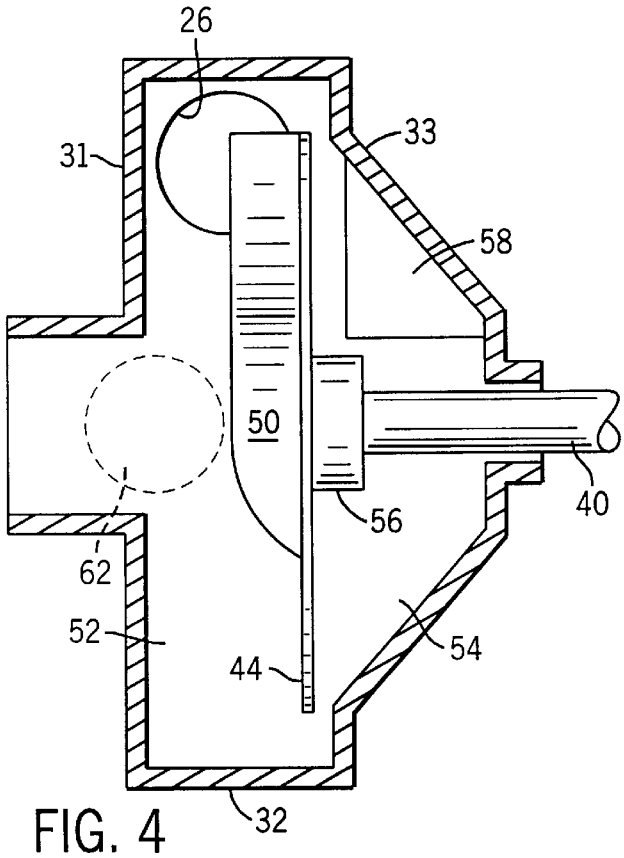
FIG. 4 is a side elevational view in cross-section of the assembled housing and impeller.

Referring now to FIGS. 3 and 4, the motor shaft 40, after passing through the cup-shaped rear face 33 of the pump housing 32 is received by a mounting flange 56 centered on a rear face of a disk-shaped backer plate 44. The backer plate 44 is an integral part of an impeller assembly 46 having a single vane 50 extending axially from the front face of the backer plate 44. The backer plate 44 is approximately equal in diameter to that of the inner volume of the pump housing 32 and extends perpendicularly from the axis of the shaft 40 so as to isolate at its front surface, a pump volume 52 within the inner volume of the pump housing 32. By the same measure, the backer plate 44 serves to isolate a rear volume 54 within the pump housing 32 and the cup-shaped rear face 33 providing a space for the motor shaft 40 and an attaching mounting flange 56.

Within the rear volume 54, a stationary vane 58 attached to an inner wall of the cup-shaped rear face 33 extends axially and radially toward the shaft 40 to obstruct the circular flow of water within the rear volume 54. This together with the close fitting of the backer plate 44 to the walls of the housing 32 reduces the tendency of filamentary materials to be drawn into the rear volume 54 to become entangled in the shaft 40.

Referring still to FIGS. 3 and 4, on the front surface of the backer plate 44 the single vane 50 extends both axially toward the pump inlet 24 and also from a periphery of the backer plate 44 toward, but not to, its center. Over most of this latter extension, the vane 50 extends axially to a uniform height above the backer plate 44, however, at its portion closest to the center of the backer plate 44, the vane 50 tapers downward toward the front surface of the backer plate 44 as shown best in FIG. 4.

Referring now to FIG. 5, the vane 50 is curved to present a convex surface as it advances with operation of the motor as indicated by direction arrow 53. The outlet 26 is directed tangentially to this rotation of the impeller assembly 46 to receive water accelerated by the vane 50.

The single vane 50 is positioned substantially on one-half of the front surface of the backer plate 44 so that its axial ridge 51 subtends from the center 60 of the backer plate 44, an angle $\alpha$ less than 180° and the entire vane 50 is contained within a subtended angle of less than 270°. The edge of the vane 50 closest to the center 60 of the backer plate 44 is displaced from the center 60 of the backer plate 44.

While the inventors do not wish to be bound to a particular theory, it is believed that this vane configuration destabilizes a central vortex in region 62 so as to prevent prolonged retention of fibrous materials in that vortex in region 62 such as may cause roping and eventual clogging of the pump. As may be seen best in FIG. 4, the housing 32 may have a height substantially higher than the vane 50 so as to provide adequate clearance for objects to be pumped through the pump without clogging the impeller assembly 46.

The impeller assembly 46 may be constructed of a flexible elastomeric material so as to better resist impact with solid objects pumped in the wash water. The impeller assembly 46 may be statically or dynamically balanced for a particular speed by means of a counter weight of additional material 63 molded into the rear portion of the backer plate 44 of a size and location as will be understood to those of ordinary skill in the art.

It is specifically intended that the present invention not be limited to the embodiments and illustrations contained herein, but that modified forms of those embodiments including portions of the embodiments and combinations of elements of different embodiments also be included as come within the scope of the following claims.

We claim:

1. In a clothes washing machine of a type having a tub for containing water and clothes, the tub having an outlet communicating with a pump so that the pump may pump water from the tub, a pump comprising:

an electric motor having a shaft;

a pump housing having a housing inlet connectable to the tub outlet and a housing outlet, the housing providing a pump volume receiving the motor shaft along an axis opposite the housing inlet, the pump volume having a height defined along the axis; and an impeller having only a single vane and fitting within the pump volume and attached to the motor shaft so as to drive water from the housing inlet to the housing outlet with rotation of the motor shaft, the vane being asymmetric with respect to an axis of rotation of the motor and extending substantially less than the pump volume height;

wherein long fibered materials entering the pump volume are more freely passed.

2. The pump of claim 1 wherein the vane subtends an angle of less than 270 degrees about an axis concentric with the motor shaft.

3. The pump of claim 1 wherein the vane has a component of extension radially from an axis concentric with the motor shaft and wherein the vane tapers axially inward at an end of the vane toward the motor shaft.

4. The pump of claim 1 wherein the vane extends in part radially from an axis concentric with the motor shaft and wherein the vane presents a convex surface in the direction that the vane advances with operation of the motor.

5. The pump of claim 1 wherein the housing inlet is axially aligned with the motor shaft.

6. The pump of claim 1 wherein the housing outlet is tangential to a path of a radial outermost edge of the vane with rotation of the motor shaft.

7. The pump of claim 1 wherein the vane projects axially from a front surface of a backing disk extending radially from the motor shaft.

8. The pump of claim 7 wherein the pump housing includes a stationary vane extending radially and axially adjacent to a rear surface of the backing disk.

9. The pump of claim 7 wherein the pump volume is substantially cylindrical and wherein the backing disk extends radially to substantially an inner radius of the pump housing.

10. The pump of claim 1 wherein the vane is constructed of a flexible elastomeric material.

* * * * *